US008784239B2

(12) United States Patent
Harvey et al.

(10) Patent No.: US 8,784,239 B2
(45) Date of Patent: Jul. 22, 2014

(54) BATTING TRAINING DEVICE

(76) Inventors: Bryan Harvey, Catawba, NC (US); Todd Wright, Statesville, NC (US)

( * ) Notice: Subject to any disclaimer, the term of this patent is extended or adjusted under 35 U.S.C. 154(b) by 87 days.

(21) Appl. No.: 13/441,258

(22) Filed: Apr. 6, 2012

(65) Prior Publication Data

US 2012/0258822 A1 Oct. 11, 2012

Related U.S. Application Data

(60) Provisional application No. 61/473,230, filed on Apr. 8, 2011.

(51) Int. Cl.
*A63B 69/00* (2006.01)
*A63B 71/00* (2006.01)

(52) U.S. Cl.
CPC ..... *A63B 69/0002* (2013.01); *A63B 2069/0008* (2013.01); *A63B 2210/50* (2013.01)
USPC ..... 473/417; 473/422; 473/453

(58) Field of Classification Search
USPC ..... 473/417–420, 422; D21/715, 780
See application file for complete search history.

(56) References Cited

U.S. PATENT DOCUMENTS

| | | | | | |
|---|---|---|---|---|---|
| 2,527,906 | A * | 10/1950 | Bennett et al. | ..... | 473/417 |
| 3,139,282 | A * | 6/1964 | Lande | ..... | 473/417 |
| 3,489,411 | A * | 1/1970 | Morelli | ..... | 473/417 |
| 4,445,685 | A * | 5/1984 | Cardieri | ..... | 473/417 |
| 4,456,250 | A * | 6/1984 | Perrone, Jr. | ..... | 473/417 |
| 4,819,937 | A * | 4/1989 | Gordon | ..... | 473/417 |
| 4,886,267 | A * | 12/1989 | Licciardi et al. | ..... | 473/417 |
| 4,993,708 | A * | 2/1991 | Prossor et al. | ..... | 473/417 |
| 5,106,085 | A * | 4/1992 | Lewy | ..... | 473/417 |
| 5,320,343 | A * | 6/1994 | McKinney | ..... | 473/417 |
| 5,540,430 | A * | 7/1996 | Nichols et al. | ..... | 473/418 |
| 5,556,091 | A * | 9/1996 | Lin | ..... | 473/417 |
| 5,928,092 | A * | 7/1999 | Keeter et al. | ..... | 473/417 |
| 5,951,413 | A * | 9/1999 | Guerriero | ..... | 473/417 |
| 6,579,195 | B2 * | 6/2003 | Lamb | ..... | 473/417 |
| 6,979,273 | B2 * | 12/2005 | Tsai | ..... | 473/417 |
| 7,063,632 | B2 * | 6/2006 | Green | ..... | 473/417 |
| 7,204,769 | B2 * | 4/2007 | Bandimere et al. | ..... | 473/417 |
| 7,479,074 | B1 | 1/2009 | Pierce | | |
| 8,257,202 | B1 * | 9/2012 | Stanek | ..... | 473/417 |
| 2007/0082762 | A1 | 4/2007 | Falgoust | | |
| 2011/0190079 | A1 * | 8/2011 | Guevara | ..... | 473/417 |
| 2012/0094786 | A1 * | 4/2012 | Spallina | ..... | 473/417 |
| 2012/0258822 | A1 * | 10/2012 | Harvey et al. | ..... | 473/417 |
| 2013/0109508 | A1 * | 5/2013 | Lay | ..... | 473/417 |

* cited by examiner

*Primary Examiner* — Mitra Aryanpour
(74) *Attorney, Agent, or Firm* — Trego, Hines & Ladenheim, PLLC

(57) ABSTRACT

A batting training device includes: a base having opposed front and rear portions and opposed left and right portions, each portion including at least one mounting point; a back pole extending upward from a mounting point in the back portion; a side pole extending upward from a mounting point in either the left or right side portions; and a tee extending upward from one a mounting point in the front portion.

14 Claims, 23 Drawing Sheets

BATTING TRAINING DEVICE

CROSS-REFERENCE TO RELATED APPLICATIONS

This application claims the benefit of Provisional Patent Application No. 61/473,230, filed Apr. 8, 2011.

BACKGROUND OF THE INVENTION

This invention relates generally to sports equipment and more particularly to a batting training device for improving batting technique.

Softball and baseball are two popular sports of the "ball-and-stick" category, in which a player (called a batter) strives to strike a ball with an implement such as a bat or club. Typically in a ball-and-stick sport it is desirable to hit a ball a long distance, or in an accurate direction, or some combination thereof.

It has been recognized that the goal of making long, accurate hits is best served by a swing technique which involves a specific set of physical movements to be performed in sequence in a very short period of time. These techniques and their study are referred to generally as "swing mechanics". Mastering proper swing mechanics can involve a large number of repetitions. When learning swing mechanics, a batter would prefer to focus solely on those mechanics, and to avoid other variables introduced by practicing with a human pitcher or a pitching machine.

It is therefore common to practice batting from a tee which holds a ball stationary in a predetermined position. However, a simple tee provides no guidance as to the proper swing mechanics, leaving the batter to rely on his own visualization techniques or on a coach.

Accordingly, there is a need for a batting training device which provides guidance that encourages proper swing mechanics.

BRIEF SUMMARY OF THE INVENTION

This need is addressed by the present invention, which provides a batting training device including physical guides that direct a player to execute a proper swing.

According to one aspect of the invention, a batting training device includes: a base having opposed front and rear portions and opposed left and right portions, each portion including at least one mounting point; a back pole extending upward from a mounting point in the back portion; a side pole extending upward from a mounting point in either the left or right side portions; and a tee extending upward from one a mounting point in the front portion.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
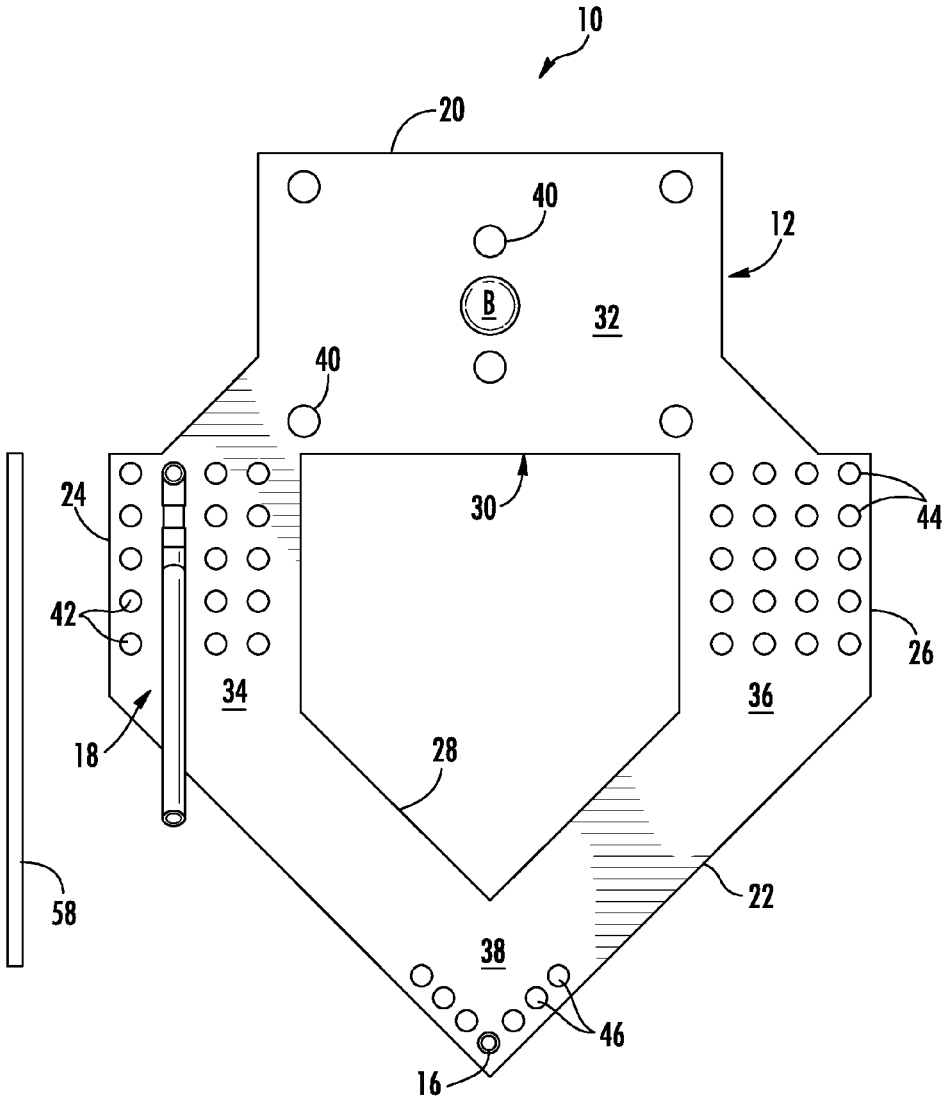
FIG. 1 is a top plan view of a batting training device constructed in accordance with an aspect of the present invention.
Figure 2:
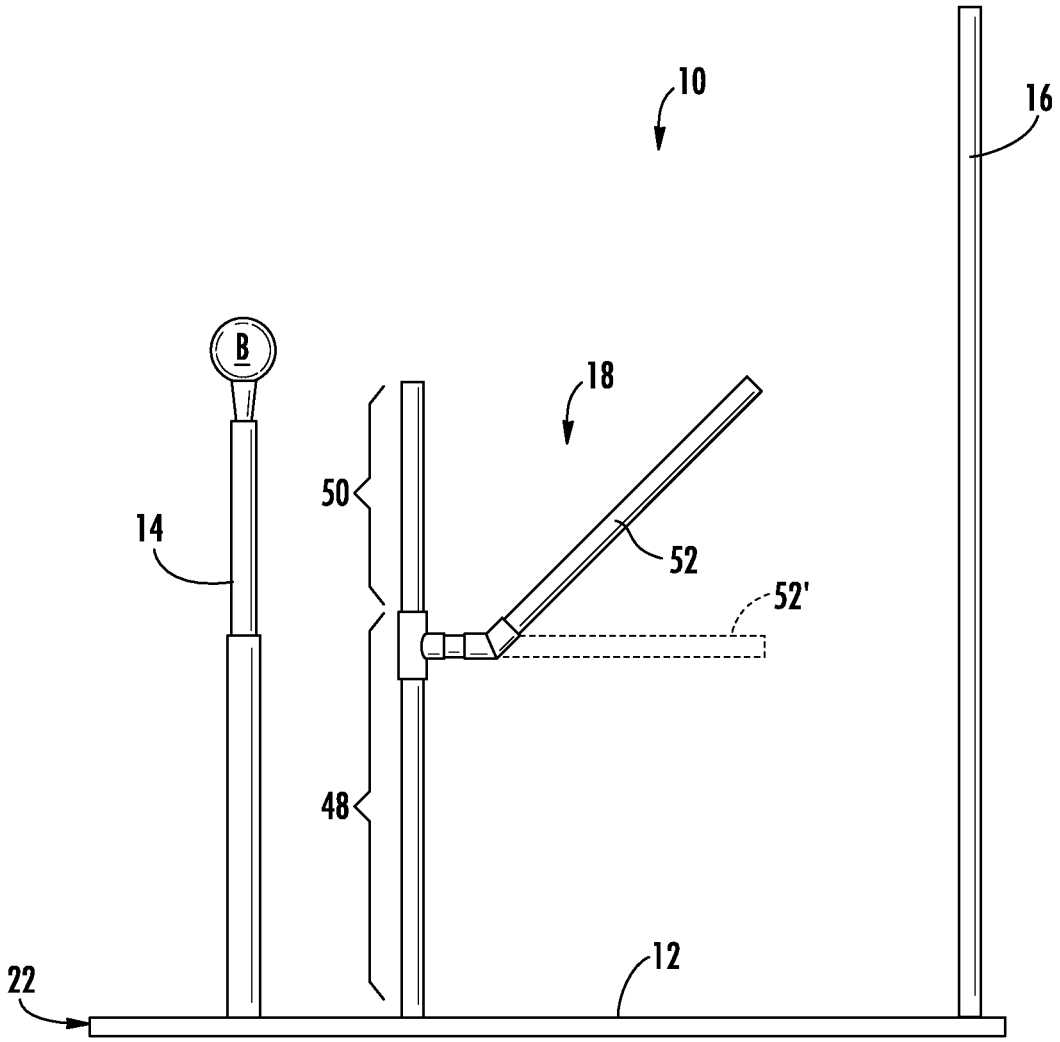
FIG. 2 is a side view of the batting training device of FIG. 1.
Figure 3:
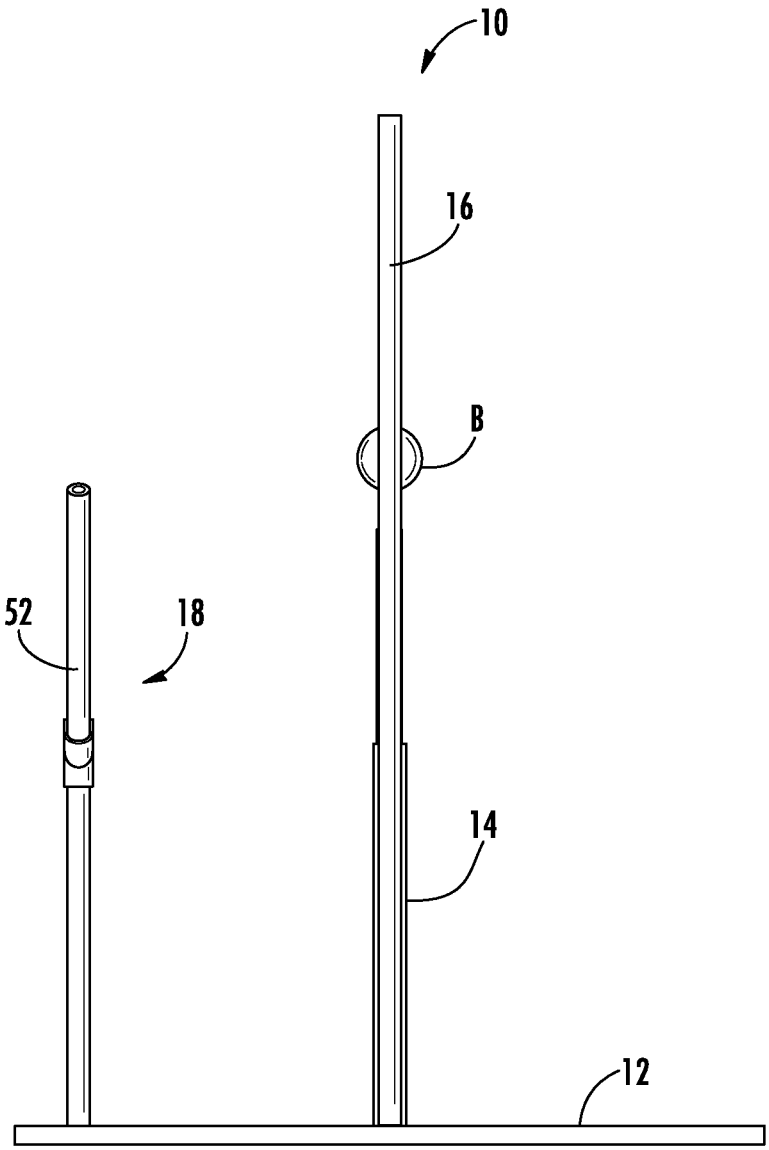
FIG. 3 is a rear view of the batting training device of FIG. 1.

Referring to the drawings wherein identical reference numerals denote the same elements throughout the various views, FIGS. 1-3 depict an exemplary batting training device 10 constructed according to an aspect of the present invention. The main components of the batting training device 10 are a base 12, a tee 14, a back pole 16, and a side pole 18.

The base 12 is generally planar and may be made from any durable, stable material, such as wood, metal, rubber, plastic, or the like. It has a thickness and a weight sufficient to support the tee 14 and the side and back poles 18 and 16, and to remain stable while a ball "B" is hit from the tee 14. For purposes of description it has a front end 20, a back end 22, a left side 24, and a right side 26. The base has a central opening 28 in the shape of an irregular pentagon, with the base 30 of the pentagon towards the front end 20. The central opening 28 is sized and shaped to accommodate a standard home base bag (not shown) as used in baseball or softball. The back end 22 is formed in a "V" shape which follows the lines of the central opening 28. A front portion 32 is defined between the front end 20 and the central opening 28, a left side portion 34 is defined between the left side 24 and the central opening 28, a right side portion 36 is defined between the right side 26 and the central opening 28, and a back portion 38 is defined between the back end 22 and the central opening 28.

The base 12 has several mounting points which will be described in detail below. As used herein, the term "mounting point" generally refers to a specific location on the base 12 (i.e. referenced to left-right and front-back directions) which includes structure capable of mounting the tee 14, the side pole 18, or the back pole 16. In the simplest embodiment, each mounting point could comprise a circular hole or shaped aperture sized to receive the respective upright member, for example with a moderate friction fit. Alternatively, a bracket or a stub post (not shown) could be provided at each mounting point to fit complementary structure on the associated upright member.

The front portion 32 has several front mounting points 40 which are sized to accept the batting tee 14. The illustrated example shows seven front mounting points. For example, the front mounting points 40 may comprise circular holes in the base 12 of slightly more than 5.1 cm (2 in.) diameter. The front mounting points 40 are placed in appropriate positions to simulate pitches approaching a batter from various angles.

The left side portion 34 has an array of left mounting points 42 which are configured to accept the side pole 18. For example, the left mounting points 42 may be circular holes of slightly more than 2.5 cm (1 in.) diameter. In the illustrated example, 20 left mounting points 42 are arranged in a rectangular grid to provide a range of spaced-apart locations in left-right and front-rear directions, so that the side pole 18 can be mounted to suit the physical measurements of a specific batter.

The right side portion 36 has an array of right mounting points 44 which are also configured to accept the side pole 18. For example, the right mounting points 44 may be circular holes of slightly more than 2.5 cm (1 in.) diameter. In the illustrated example, 20 right mounting points 44 are arranged in a rectangular grid to provide a range of spaced-apart locations in left-right and front-rear directions, so that the side pole 18 can be mounted to suit the physical measurements of a specific batter.

Finally, the back portion 38 has an array of back mounting points 46 which are configured to accept a back pole 16. For example, the back mounting points 46 may be circular holes of slightly more than 2.5 cm (1 in.) diameter. In the illustrated example, 7 back mounting points 46 are arranged in a "V" shape to provide a range of spaced-apart locations in left-right and front-rear directions, so that the back pole 16 can be mounted to suit the physical measurements of a specific batter.

The upright tee 14 is mounted at one of the front mounting points 40 in the front portion 32 and extends upward therefrom. Any relatively rigid material that will stand upright and be durable to mild impacts may be used, for example tubular molded plastic. The upper end of the tee 14 is configured to hold a ball B. In the illustrated example the ball B is a standard baseball of about 7.3 cm (2⅞ in.) diameter. Such tees 14 are commercially available and may be adjustable in height.

The upright back pole 16 is mounted at one of the back mounting points 46 and extends upward therefrom. Any relatively rigid material that will stand upright and be durable to mild impacts may be used. In the illustrated example, the back pole 16 is a length of ¾" schedule 40 polyvinylchloride (PVC) piping, approximately 122 cm (48 in.) tall.

The upright side pole 18 is mounted at one of the left mounting points 42 or one of the right mounting points 44 (depending on whether the batter is right or left handed, respectively) and extends upward therefrom. The total length of the side pole 18 is about 46 cm (18 in.) to about 89 cm (35 in.). The height may be adjustable, for example by making part or all of it from telescoping sections. The side pole has a lower section 48 and an upper section 50. Any relatively rigid material that will stand upright and be durable to mild impacts may be used for the lower section 48. In the illustrated example, the lower section 48 is a length of ¾" schedule 40 polyvinylchloride (PVC) pipe.

The upper section 50 is made from a material that stands upright but will at least partially deflect from impacts and/or absorb impacts. For example, the upper section 50 may be made from a small-diameter pipe or rod, a padded pipe or rod, or dense foam.

Optionally, the side pole 18 may include an auxiliary arm 52. The auxiliary arm 52 may extend at an angle axially rearward and upward. In the example shown, the auxiliary arm 52 extends at an angle of approximately 45 degrees aft of the vertical lower section 48 of the side pole 18. Alternatively, the auxiliary arm can extend in a purely horizontal direction, as shown by the dashed lines marked 52' in FIG. 2.

Figure 5:
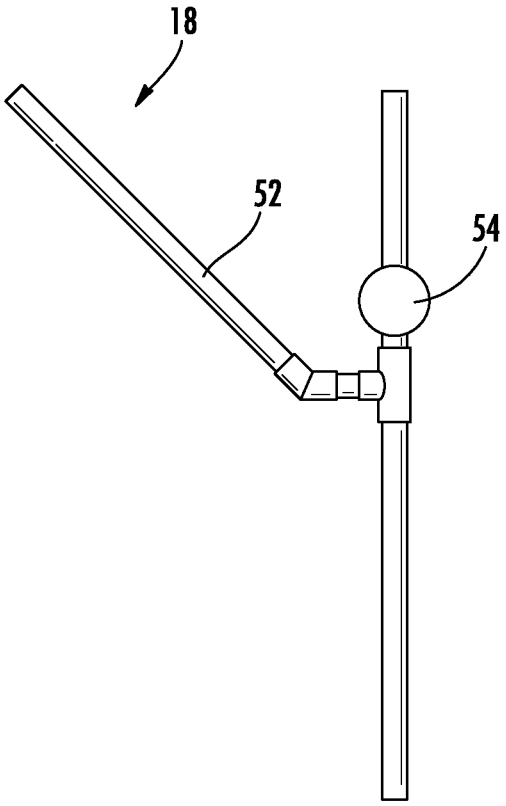
FIG. 5 is a right side view of the side pole of FIG. 4.
Figure 4:
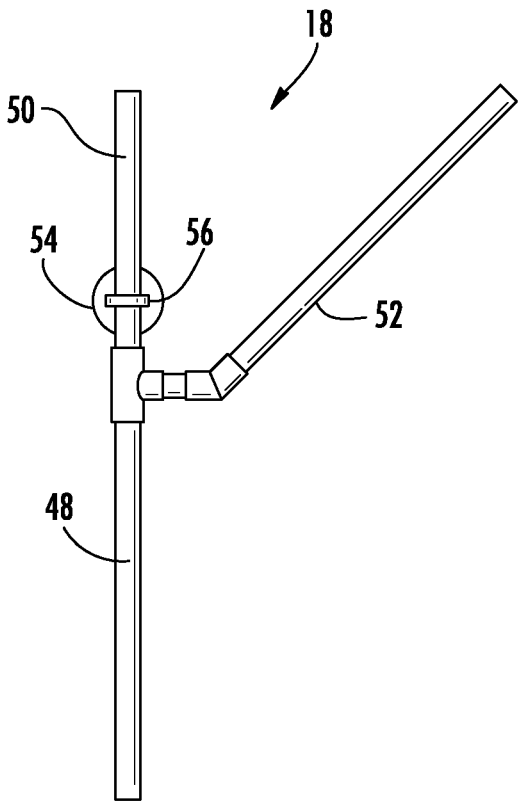
FIG. 4 is a left side view of an alternate side pole for use with the batting training device shown in FIG. 1.
Figure 6:
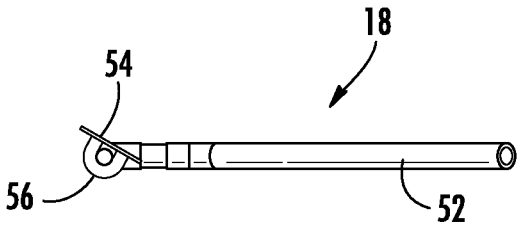
FIG. 6 is a top view of the side pole of FIG. 4.

As seen in FIGS. 4-6, the side pole 18 may include an optional target 54. The target 54 may be any convenient shape or size to attract a user's attention and serve as a focal spot. In the illustrated example the target 54 is a circular disk of about 7.6 cm (3 in.) diameter. The target 54 is mounted to the side pole 18 at a position where a bat is expected to be at the end of a swing, e.g. on the upper section 50 facing approximately towards the right side 26 of the base 12. The target 54 may be mounted so that it can swing out of the way when contacted by a bat. In the illustrated example, the target 54 is attached to an annular band 56 which fits around the upper section 50 of the side pole 18, for example with a friction fit.

The batting training device 10 is used by placing the base 12 in a suitable area, for example in a batting practice cage. Optionally it can be placed with the central opening 28 surrounding a home plate bag (not shown). The tee 14 is placed in one of the front mounting points 40, the back pole 16 is placed in one of the back mounting points 46, and the side pole 18 is placed in one of the left or right mounting points 42 or 44 (the left side position is shown in the examples, for a right-handed batter). The positions of the side pole 18 and the back pole 16 are determined by the batter's physical measurements and the size of the bat. A ball B is placed on the tee 14. A batter (not shown) may then stand in position, for example on a base line 58 marked on the floor adjacent the base 12, and hit the ball from the tee 14.

Figure 7:
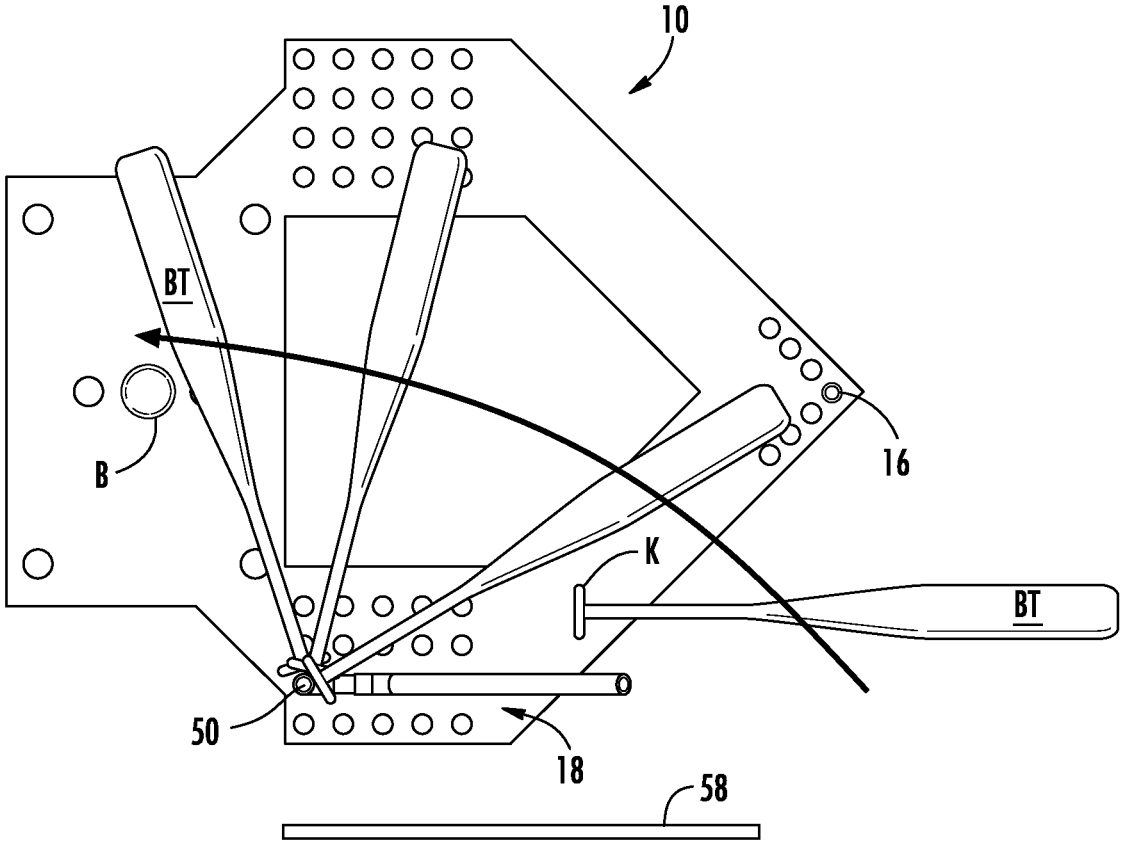
FIG. 7 is a top view of the batting training device of FIG. 1, with a bat superimposed thereupon.
Figure 8:
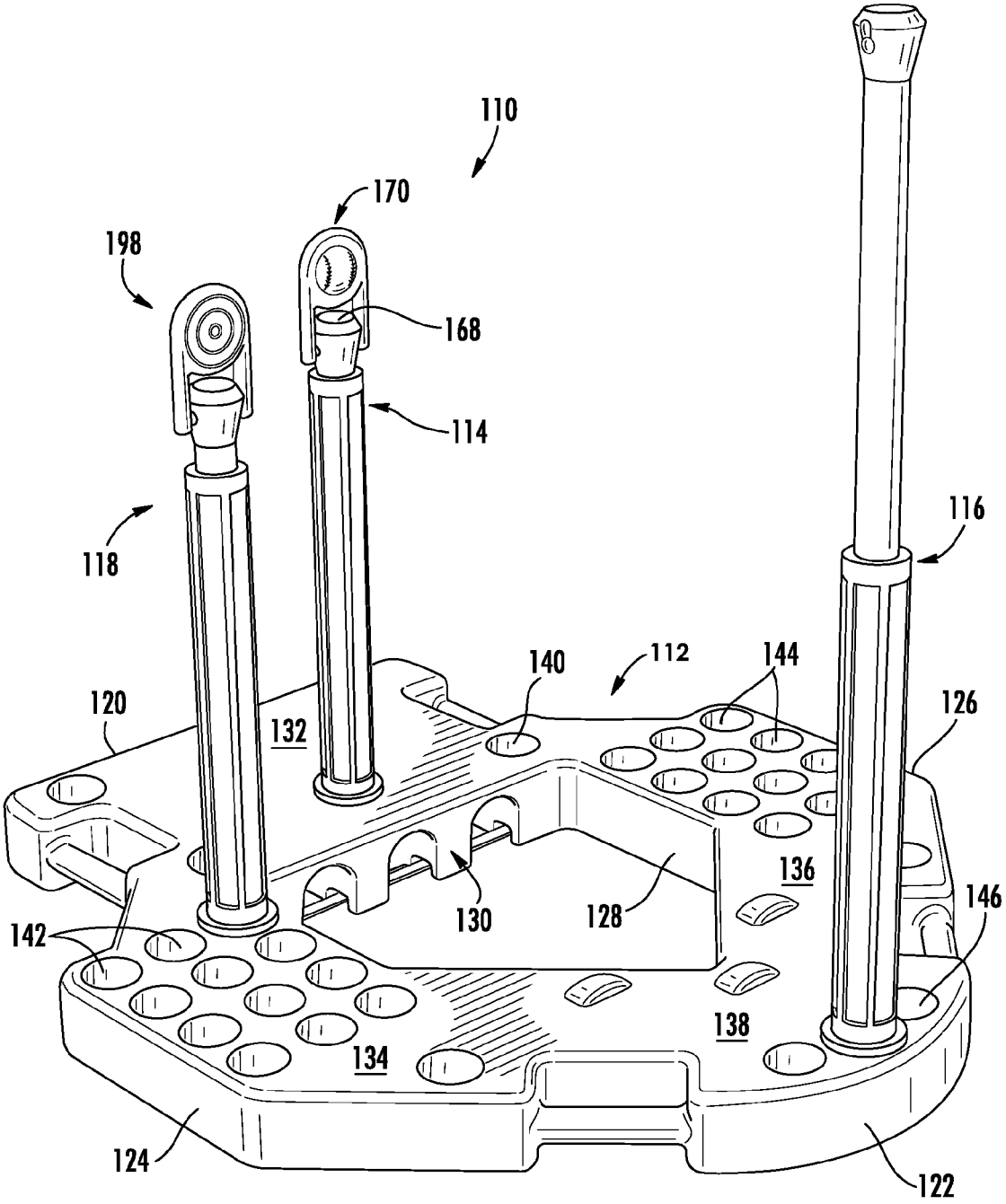
FIG. 8 is a rear perspective view of an alternative batting training device.
Figure 9:
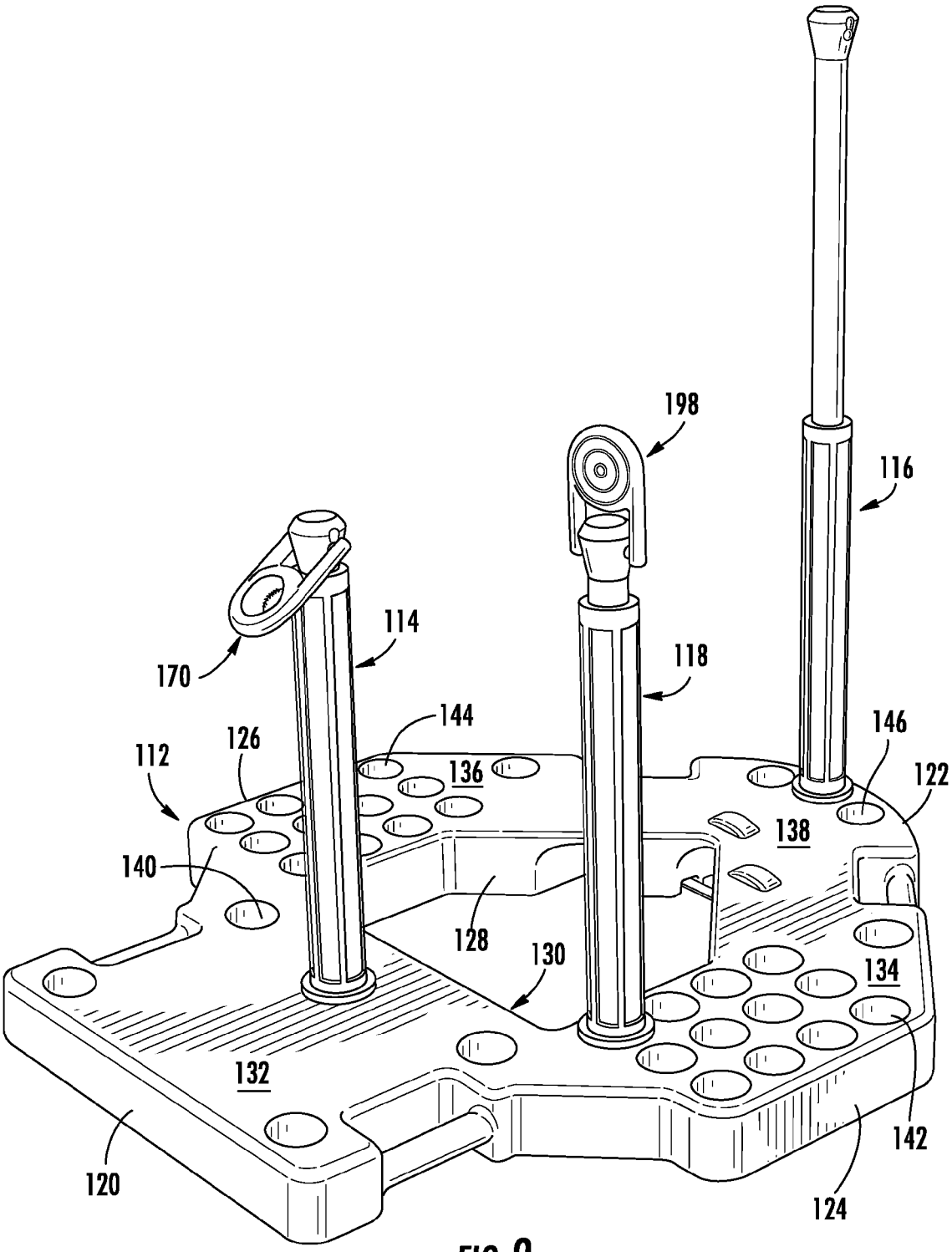
FIG. 9 is a front perspective view of the batting training device of FIG. 8.

FIG. 7 schematically illustrates a bat "BT" in a sequence of positions (from right to left) during a correct swing. The back pole 16 presents a visual and physical barrier to the bat BT at the early stages of the swing, serving as a reminder not to allow the bat BT to move away from the batter's body. The side pole 18 serves as a target for the final portion of the swing. Specifically, the batter attempts to bring a knob "K" of the bat BT into contact with the upper section 50 of the side pole 18. The padding and/or resilient nature of the upper section 50 allows it to survive repeated hits from the bat BT while avoiding injury to the batter. After the knob K contacts the upper section 50, the batter then allows his wrists to "release" or un-hinge, swinging the bat BT through an arc and contacting the ball B. If the optional auxiliary arm 52 is used, its angle can serve as a visual guide to the batter for the proper angle to bring the bat BT towards the upper section 50 during the latter part of the swing. The auxiliary arm 52 or 52' can also serve to block the batter's legs from moving forward into an improper position during a swing. The back pole 16 and the side pole 18 provide immediate visual, audible, and tactile feedback if the bat BT is too far from the batter's body or misses the intended swing path.

If the optional target 54 is used, the batter brings the bat knob K into contact with the target 54, and the target 54 pivots so as to follow the arc of the bat BT.

FIGS. 8-24 depict an alternative batting training device 110 constructed according to an aspect of the present invention. It is generally similar to the batting training device 10 described above, and its main components are a base 112, a tee 114, a back pole 116, and a side pole 118.

The base 112 is generally planar and may be made from any durable, stable material, such as wood, metal, rubber, plastic, or the like. Optionally it could be made hollow with provisions for filling it with sand or water. In the illustrated example the base 112 is formed from molded plastic. It has a thickness and a weight sufficient to support the tee 114 and the side and back poles 118 and 116, and to remain stable while swinging motion is performed. For purposes of description it has a front end 120, a back end 122, a left side 124, and a right side 126. The base has a central opening 128 in the shape of an irregular pentagon, with the base 130 of the pentagon towards the front end 120. The central opening 128 is sized and shaped to accommodate a standard home base bag (not shown) as used in baseball or softball. The back end 122 is formed generally in a "V" shape which follows the lines of the central opening 128. A front portion 132 is defined between the front end 120 and the central opening 128, a left side portion 134 is defined between the left side 124 and the central opening 128, a right side portion 136 is defined between the right side 126 and the central opening 128, and a back portion 138 is defined between the back end 122 and the central opening 128.

The base 112 has several mounting points which will be detailed below. As noted above, the term "mounting point" generally refers to a specific location on the base 112 (i.e. referenced to left-right and front-back directions) which includes structure capable of mounting the tee 114, the side pole 118, or the back pole 116. In the specific example illustrated, each mounting point comprises a circular socket sized to receive the respective upright member, for example with a moderate friction fit.

The front portion 132 has several front mounting points 140 which are sized to accept the tee 114. The illustrated example shows five front mounting points 140. The front mounting points 140 are placed in appropriate positions to simulate pitches approaching a batter from various angles.

The left side portion 134 has an array of left mounting points 142 which are configured to accept the side pole 118. In the illustrated example, 12 left mounting points 142 are arranged in a rectangular grid to provide a range of spaced-apart locations in left-right and front-rear directions, so that the side pole 118 can be mounted to suit the physical measurements of a specific batter.

The right side portion 136 has an array of right mounting points 144 which are also configured to accept the side pole 118. In the illustrated example, 12 right mounting points 144 are arranged in a rectangular grid to provide a range of spaced-apart locations in left-right and front-rear directions, so that the side pole 118 can be mounted to suit the physical measurements of a specific batter.

Finally, the back portion 138 has an array of back mounting points 146 which are configured to accept a back pole 116. In the illustrated example, five back mounting points 146 are arranged in a rough "V" shape to provide a range of spaced-apart locations in left-right and front-rear directions, so that the back pole 116 can be mounted to suit the physical measurements of a specific batter.

The upright tee 114 is mounted at one of the front mounting points 140 in the front portion 132 and extends upward therefrom. The tee 114 is shown in more detail in FIG. 12. It may be made from any relatively rigid material that will stand upright and be durable to mild impacts, for example molded plastic or rubber. The tee 114 has an outer tube 160 and an inner member 162 assembled in a friction-fit telescoping relationship so that the total height of the tee 114 is adjustable. The bottom end of the tee 144 is formed into a tapered plug 164 and includes a radially-extending flange 166. The upper end of the tee 114 is configured to hold a ball, for example by including a shallow concave depression 168 (best seen in FIG. 8).

Figure 24:
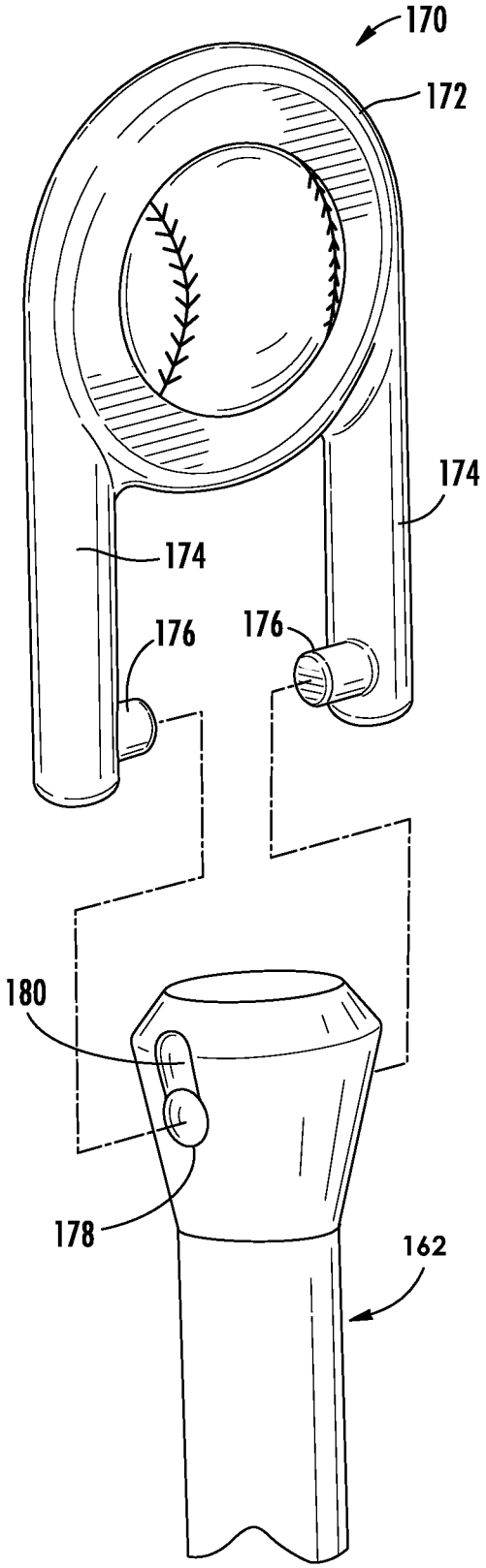
FIG. 24 is an exploded perspective view showing the assembly of a target to a pole.
Figure 25:
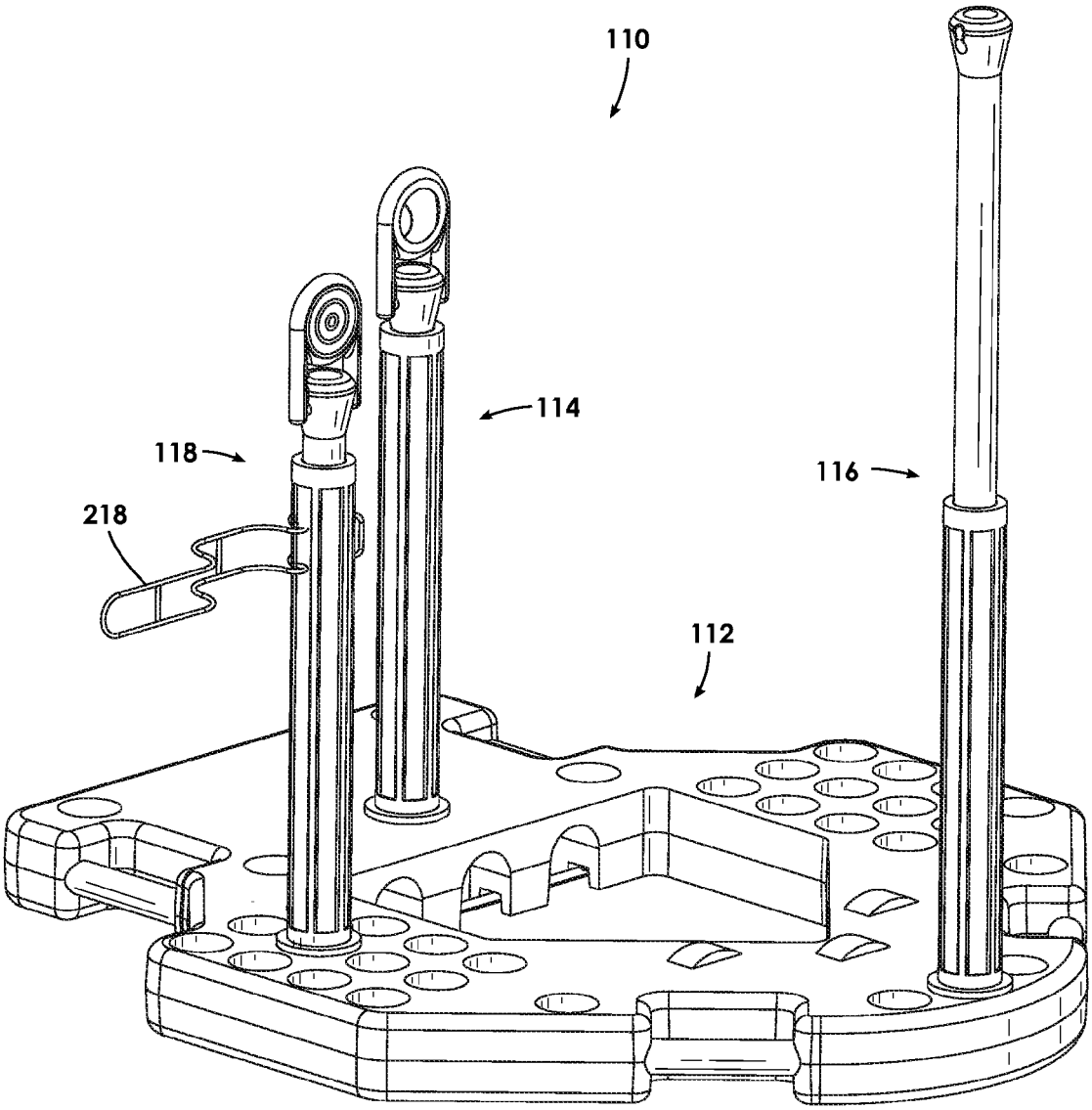
FIG. 25 is a rear perspective view of the batting training device of FIG. 8 with a knee bar attached thereto.

The tee 114 includes a flip-down hitting target 170. The hitting target 170 may be made from any relatively rigid material that is durable to mild impacts, for example molded plastic or rubber. FIGS. 14 through 18 illustrate the hitting target 170 in more detail. The hitting target 170 has a disk-like body 172 which a pair of generally parallel legs 174 extending therefrom. In the illustrated example, the body 172 has a raised shape representing a baseball formed thereon. Each leg 174 includes a stub shaft 176 extending laterally therefrom, such that the two stub shafts 176 extend towards each other and are co-axial to each other. As seen in FIG. 24, each of the stub shafts 176 is received in one of a pair of holes 178 formed on opposite sides of the inner member 162, at its upper end. Shallow vertical channels 180 are formed on opposite sides of the inner member 162 and connect with the holes 178. The channels 180 serve to receive the legs 176 and retain the hitting target 170 upright until it is hit by a bat (in other words, the channels 180 releasably hold the legs 176). When struck, the legs 176 can deflect outward enough to disengage the channels 180 and allow the hitting target 114 to pivot about the stub shafts 176 and swing downward.

The upright back pole 116 is mounted at one of the back mounting points 146 and extends upward therefrom. It may be made from any relatively rigid material that will stand upright and be durable to mild impacts, for example molded plastic or rubber. The back pole 116 is shown in more detail in FIG. 13. The back pole 116 has an outer tube 182 and an inner member 184 assembled in a friction-fit telescoping relationship so that the total height of the back pole 116 is adjustable. The bottom end of the back pole 116 is formed into a tapered plug 186 and includes a radially-extending flange 188. For purposes of reducing parts count and minimizing manufacturing costs, the back pole 116 may be identical in construction to the tee 114. For example, as illustrated the back pole 116 includes the structural features needed to hold a ball and to receive a flip-down target as described above, although those features are not used in the case of the back pole 116.

The upright side pole 118 is mounted at one of the left mounting points 142 or one of the right mounting points 144 (depending on whether the batter is right or left handed, respectively) and extends upward therefrom. It may be made from any relatively rigid material that will stand upright and be durable to mild impacts, for example molded plastic or rubber. The side pole 118 is shown in more detail in FIG. 11. The side pole 118 has an outer tube 190 and an inner member 192 assembled in a friction-fit telescoping relationship so that the total height of the side pole 118 is adjustable. The bottom end of the side pole 118 is formed into a tapered plug 194 and includes a radially-extending flange 196. For purposes of reducing parts count and minimizing manufacturing costs, the side pole 118 may be identical in construction to the tee 114.

The side pole 118 includes a flip-down bat target 198. The bat target 198 may be made from any relatively rigid material that is durable to mild impacts, for example molded plastic or rubber. FIGS. 19 through 23 illustrate the bat target 198 in more detail. The bat target 198 has a disk-like body 200 which a pair of generally parallel legs 202 extending therefrom. In the illustrated example, the body 200 has a raised shape representing several concentric rings formed thereon. Each leg 202 includes a stub shaft 204 extending laterally therefrom, such that the two stub shafts 204 extend towards each other and are co-axial to each other. The stub shafts 204 are mounted to holes in the side pole 118 in the same manner that the stub shafts 176 are mounted to the tee 114 (described above). Channels (not shown) identical to the channels 180 described above serve to receive the legs 202 and retain the bat target 198 upright until it is hit by a bat. When struck, the legs 202 can deflect outward enough to disengage the channels and allow the bat target 198 to pivot about the stub shafts 204 and swing downward.

The operation of the batting training device 110 is substantially the same as for the batting training device 10 described above. During a swing, the batter brings the bat knob K into contact with the bat target 198, which pivots or "flips down" so as to follow the arc of the bat BT. As the bat BT crosses the tee 114, it contacts the hitting target 170 which pivots or "flips down" to allow the bat BT to pass over it. After a swing is complete, the targets 170 and 198 can be pivoted back into an upright position, ready for another swing. Alternatively, the targets 170 and 198 may be left down and not used.

Figure 10:
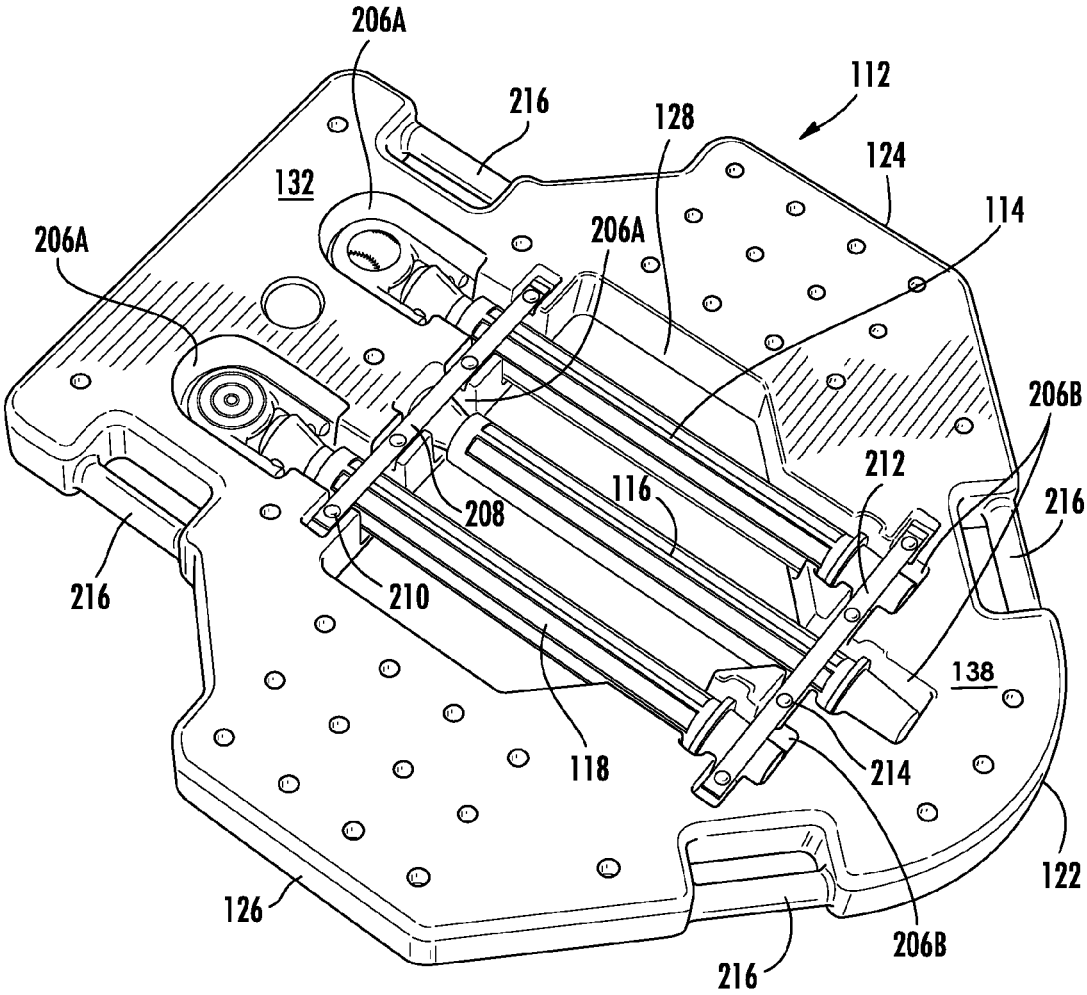
FIG. 10 is a bottom perspective view of the batting training device of FIG. 8.
Figure 11:
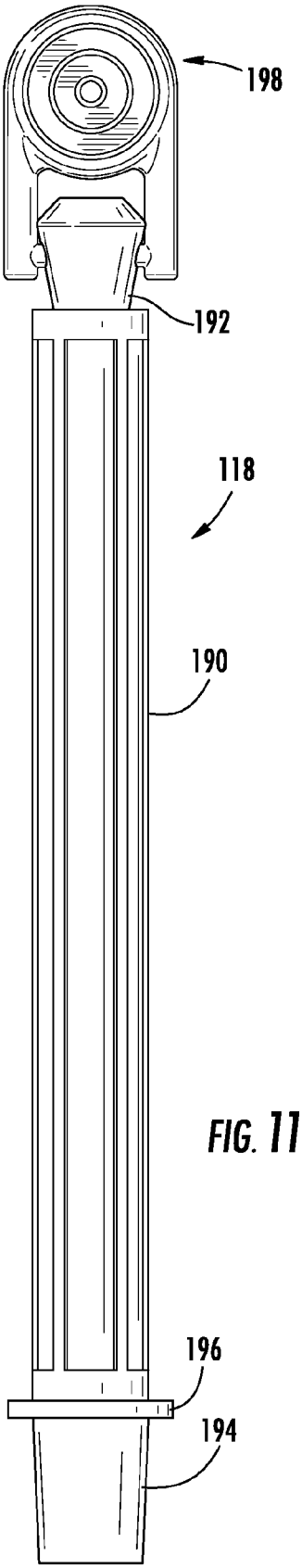
FIG. 11 is a front elevation view of a side pole of the batting training device of FIG. 8.
Figure 12:
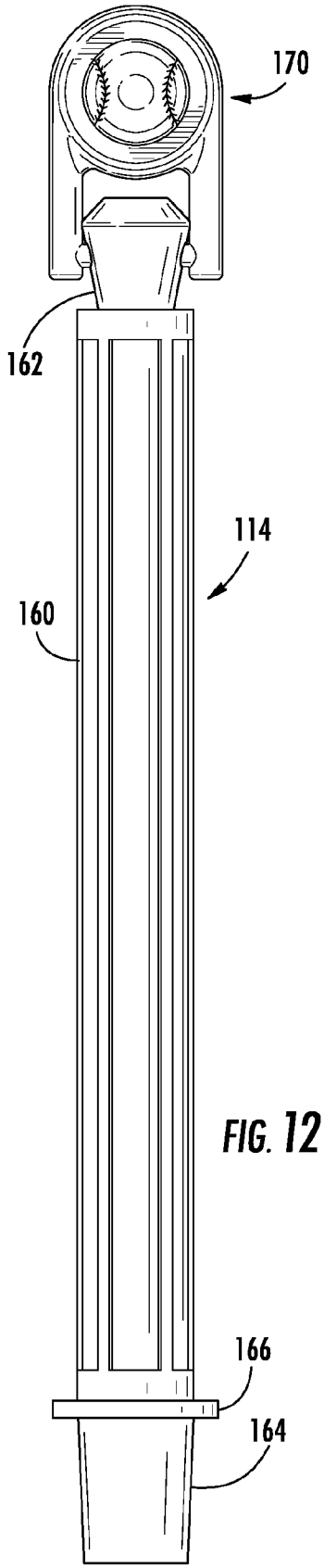
FIG. 12 is a front elevation view of a tee of the batting training device of FIG. 8.
Figure 13:
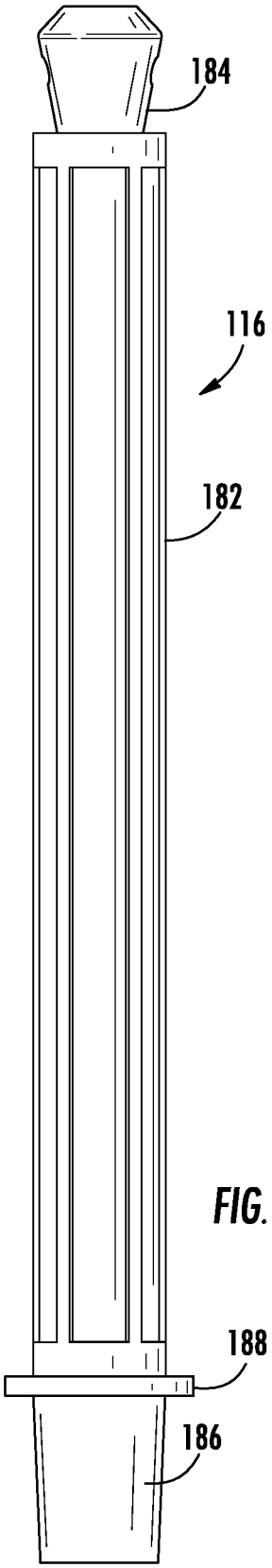
FIG. 13 is a front elevation view of a back pole of the batting training device of FIG. 8.
Figure 14:
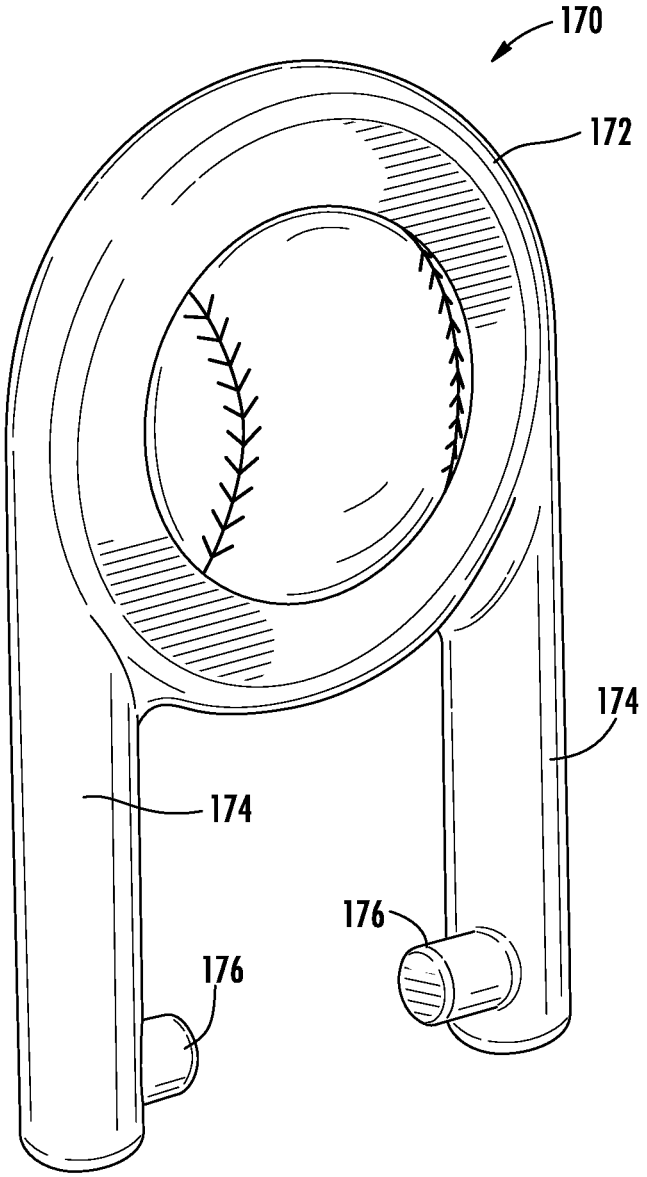
FIG. 14 is a perspective view of a hitting target.
Figure 15:
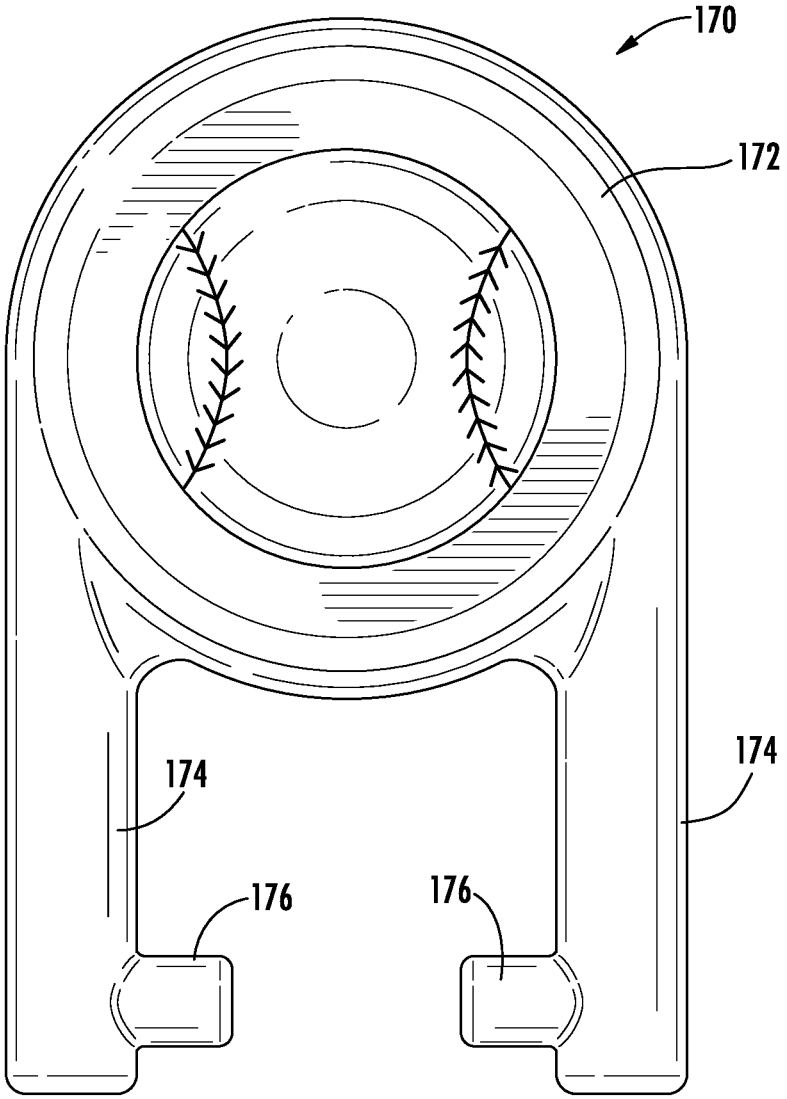
FIG. 15 is a front elevation view of the hitting target of FIG. 14, the rear elevation view being a mirror image thereof.
Figure 16:
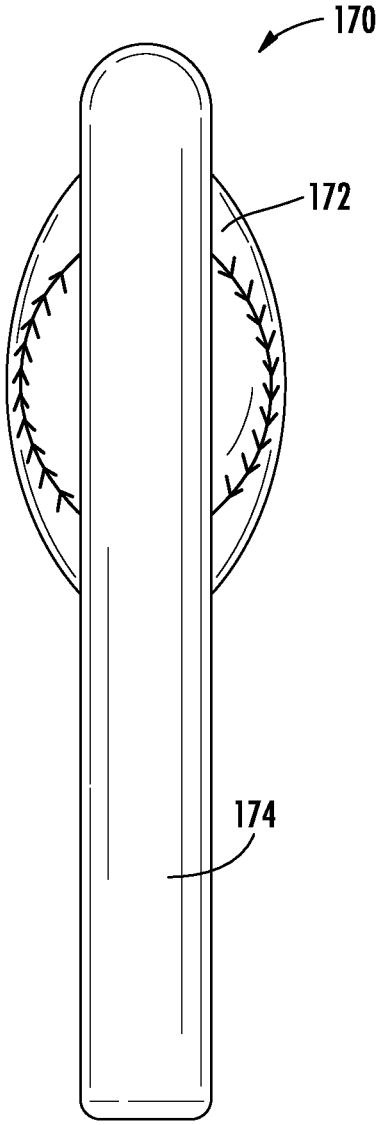
FIG. 16 is a left side elevation view of the hitting target of FIG. 14, the right side elevation view being a mirror image thereof.
Figure 17:
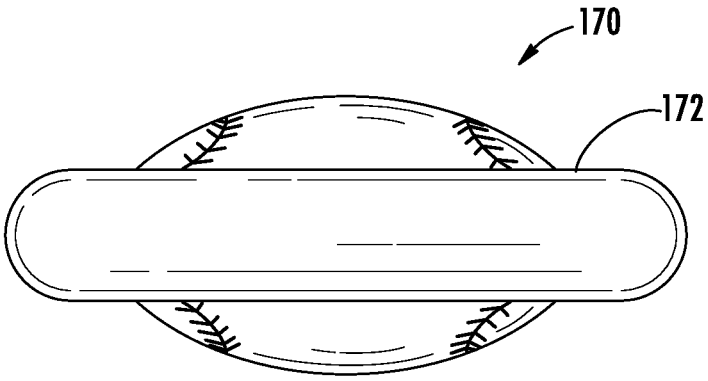
FIG. 17 is a top plan view of the hitting target of FIG. 14.
Figure 18:
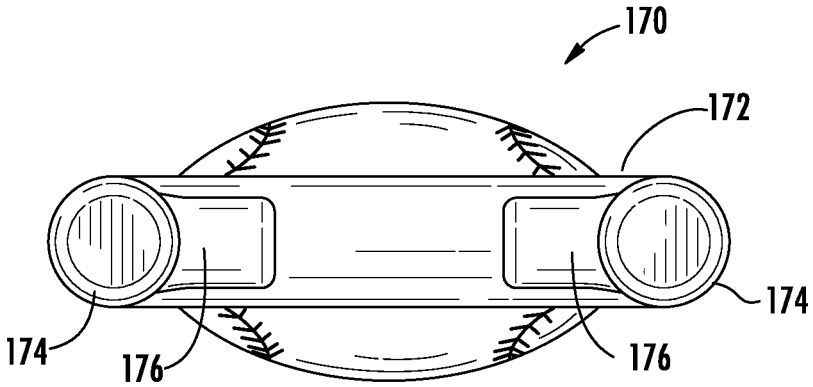
FIG. 18 is a bottom plan view of the hitting target of FIG. 14.
Figure 19:
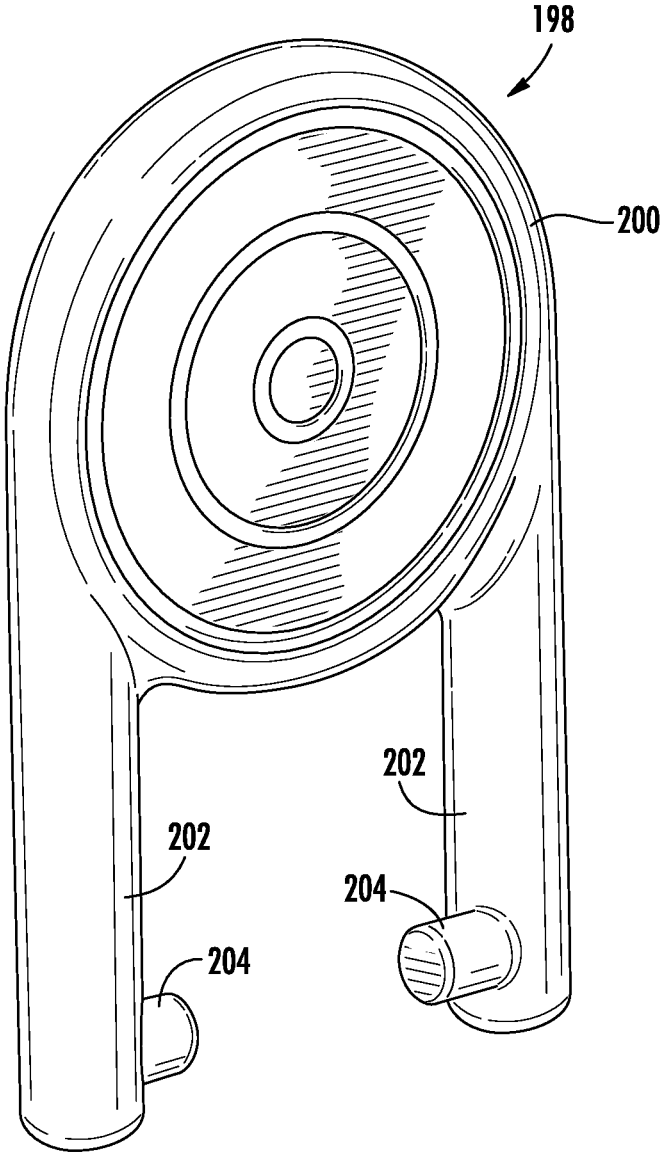
FIG. 19 is a perspective view of a bat target.
Figure 20:
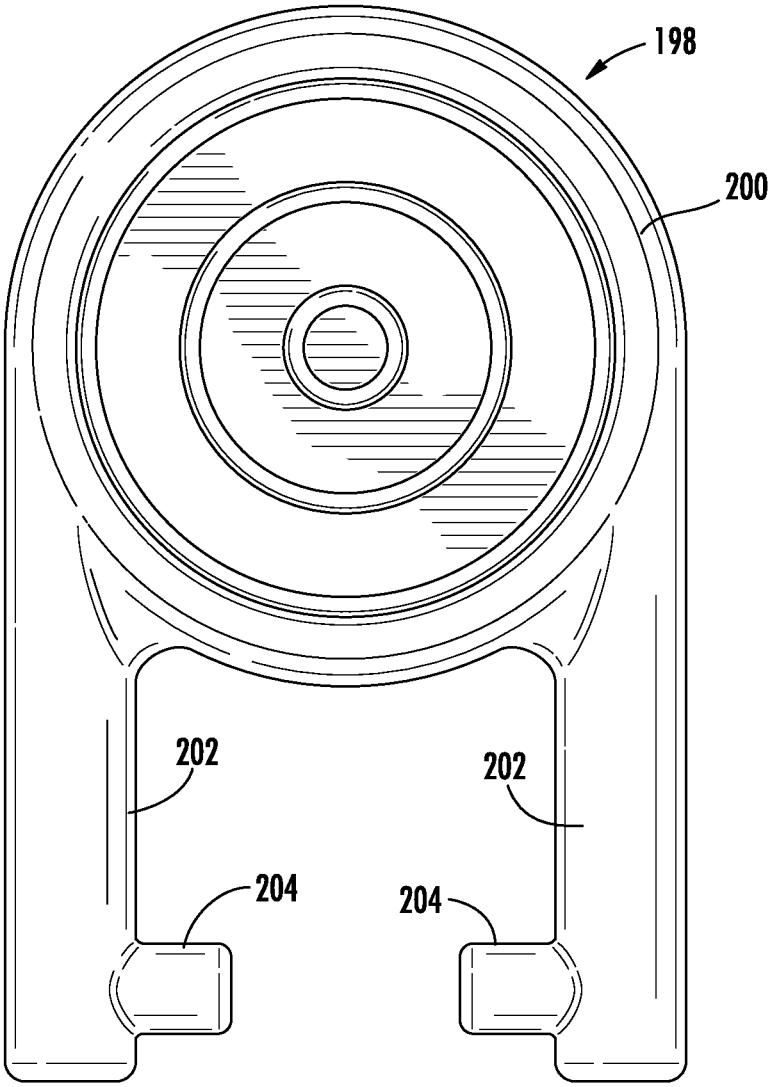
FIG. 20 is a front elevation view of the bat target of FIG. 19, the rear elevation view being a mirror image thereof.
Figure 21:
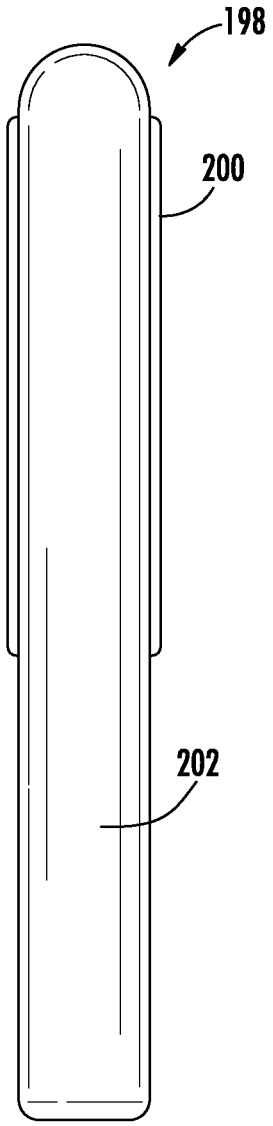
FIG. 21 is a left side elevation view of the bat target of FIG. 19, the right side elevation view being a mirror image thereof.
Figure 22:
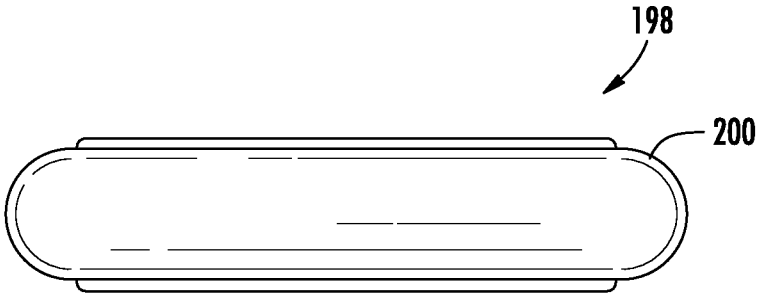
FIG. 22 is a top plan view of the bat target of FIG. 19.
Figure 23:
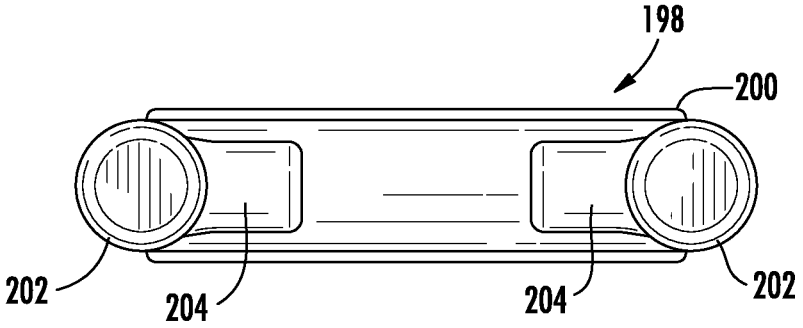
FIG. 23 is a bottom plan view of the bat target of FIG. 19.

Referring now to FIG. 10, the of the base 112 includes optional means for storing the tee 114, the back pole 116, and the side pole 118. Specifically, recesses (referred to generally at 206) are formed in the underside of the base 112. Their depth, shape, and dimensions are selected to receive the upright members 114, 116, and 118. A set of first recesses 206A is formed in the front portion 132, and a set of rear recesses 206B is formed in the rear portion 138. Each of the first recesses 206A is aligned with a corresponding one of the second recesses 206B. For storage, each of the upright members 114, 116, and 118 is placed in position generally parallel to the underside of the base 112, with one end in one of the first recesses 206A, and its opposite end in one of the second recesses 206B. In this position, the upright members 114, 116, and 118 lie flush with the bottom surface of the base, forming a compact shape for storage or transportation. A first retaining strap 208 passes across the upper ends of the upright members 114, 116, and 118 to secure them in place, and is itself secured to the base 112 with a plurality of snap fasteners 210. A second retaining strap 212 passes across the lower ends of the upright members 114, 116, and 118 to secure them in place, and is itself secured to the base 112 with a plurality of snap fasteners 214. The base 112 may also be equipped with one or more handles 216 to ease transportation.

As seen in FIGS. 25-28, the batting training device 110 may include an optional knee bar 218. The knee bar 218 is mounted to the side pole 118 and extends laterally outward, such that it will extend between a batter's knees during a swing. During the beginning of the swing, the batter shifts the knee of his back leg forward to contact the knee bar 218. Contact with the knee bar 218 provides immediate tactile feedback that he has accomplished this step.

Figure 27:
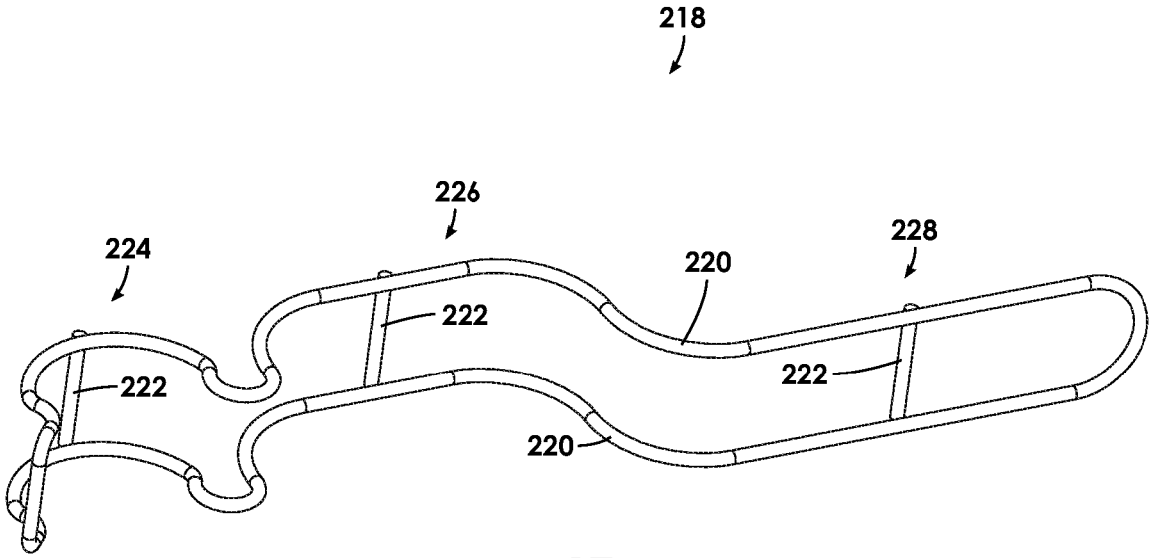
FIG. 27 is a perspective view of a knee bar shown in FIG. 25.
Figure 28:
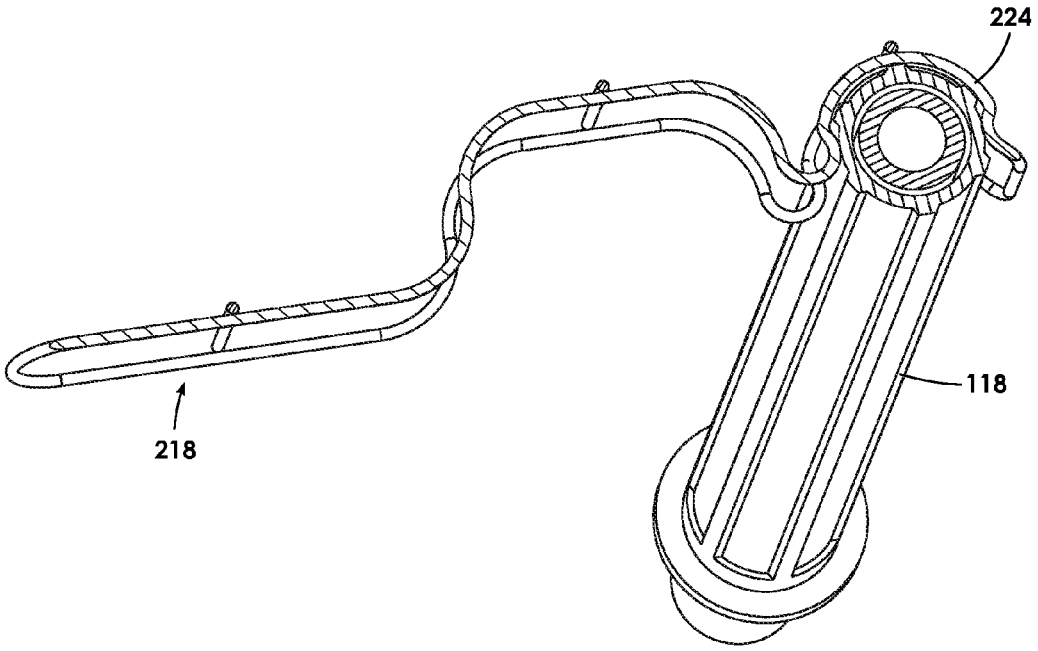
FIG. 28 is a partially-sectioned perspective view of the knee bar mounted to a side pole.

Various configurations and materials may used for the knee bar 218. In the illustrated example the knee bar 218 is a metallic wire frame structure. Referring to FIG. 27, the knee bar 218 includes a closed loop wire frame having two spaced-apart main bars 220 interconnected by crossbars 222. The knee bar 218 defines a generally C-shaped mounting clip 224, a central portion 226, and an end portion 228 which is laterally offset from the central portion 226 and the mounting clip 224. FIG. 28 illustrates how the mounting clip 224 is sized to around and resiliently engage the side pole 118 to hold the knee bar 218 at a desired height and angular position relative to the side pole 118.

Figure 26:
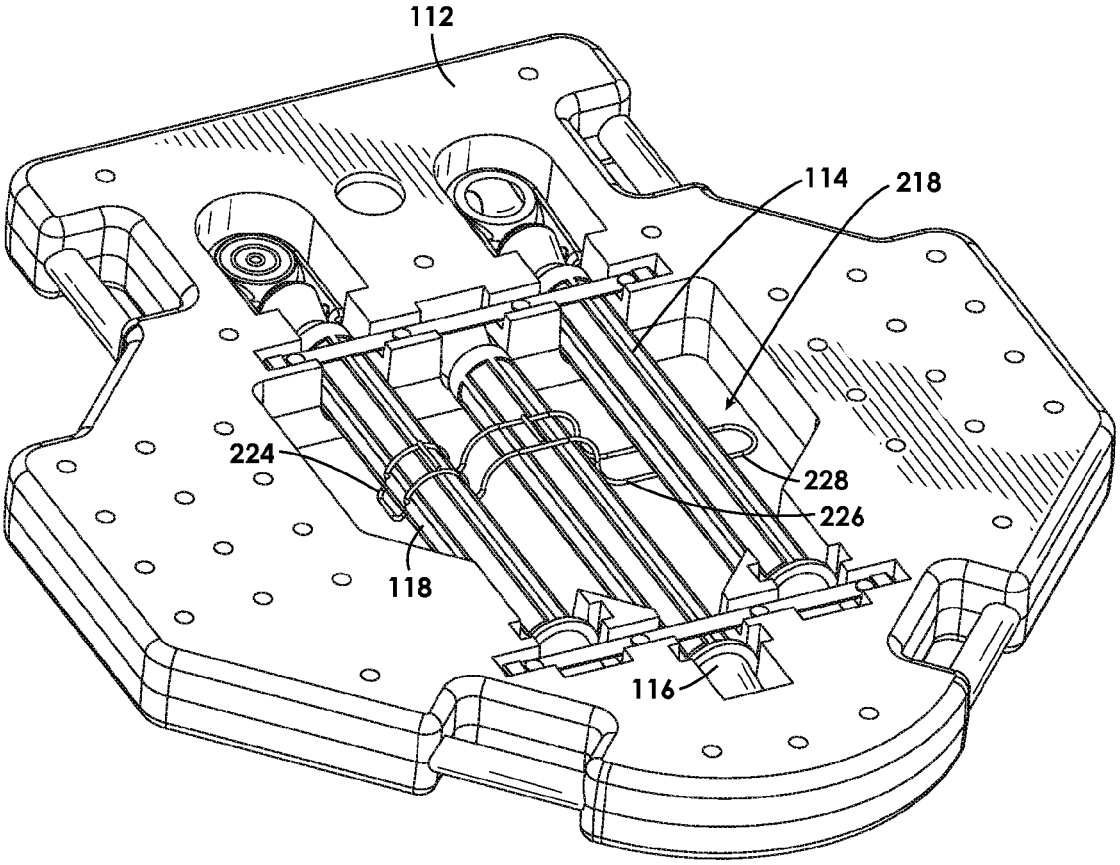
FIG. 26 is a bottom perspective view of the batting training device of FIG. 8.

FIG. 26 shows the knee bar 218 stored within the base 112. The mounting clip 224 is snapped around the side pole 118, the central portion 226 lies against the back pole 116, and the end portion 228 lies against the tee 114 on the opposite side (i.e. towards the top of the base 112). This provides a secure and compact storage configuration.

The batting training device described herein is effective to provide visual and physical targets and boundaries for proper batting swing mechanics. It will allow a batter to practice proper swing mechanics without outside assistance.

The foregoing has described a batting training device and a method for its use. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only.

What is claimed is:

1. A batting training device comprising:

a base having opposed front and rear portions and opposed left and right portions, each portion including at least one mounting point;

a back pole extending upward from a mounting point in the back portion;

a side pole extending upward from a mounting point in either the left or right side portions; and a tee extending upward from a mounting point in the front portion;

wherein at least one of the tee or the side pole carries a target at an upper end thereof which is configured to pivot from an upright position to a lowered position when struck, the target comprising a body, a pair of legs extending from the body, and a stub shaft extending laterally from a distal end of each leg, wherein each stub shaft is received in a hole in the upper end of the tee or the side pole.

2. The batting training device of claim 1 wherein at least one of the tee, the back pole, and the side pole comprises an outer tube and an inner member assembled in a friction-fit telescoping relationship.

3. The batting training device of claim 1 wherein at least one of the tee, the back pole, and the side pole includes a concave depression formed at its upper end.

4. The batting training device of claim 1 wherein a lower end of at least one of the tee, the back pole, and the side pole is formed into a tapered plug shape and includes a radially-extending flange.

5. The batting training device of claim 1 wherein each mounting point comprises a circular socket in the base.

6. The batting training device of claim 1 wherein a plurality of spaced-apart mounting points are disposed in each of the front, rear, left, and right portions.

7. The batting training device of claim 1 wherein the base includes a central opening in the shape of an irregular pentagon.

8. The batting training device of claim 1 wherein at least one recess is formed in an underside of the base, the recess sized to accept one of the tee, the side pole, or the back pole in a position generally parallel to an underside of the base.

9. The batting training device of claim 8 further comprising a retaining strap extending across the recess and adapted to secure one of the tee, the side pole, or the back pole in the recess.

10. The batting training device of claim 1 further comprising at least one handle carried by the base.

11. The batting training device of claim 1 wherein the upper end of the tee or the side pole to which the target is attached includes a pair of spaced-apart channels formed therein, the channels positioned to receive and releasably hold the legs to maintain the target in an upright position.

12. A batting training device comprising:

a base having opposed front and rear portions and opposed left and right portions, each portion including at least one mounting point;

a back pole extending upward from a mounting point in the back portion;

a side pole extending upward from a mounting point in either the left or right side portions;

a tee extending upward from a mounting point in the front portion; and a knee bar extending laterally outward from the side pole, wherein the knee bar comprises a wire frame structure.

13. The batting training device of claim 12 wherein the knee bar includes a generally C-shaped mounting clip which resiliently engages the side pole.

14. The batting training device of claim 12 wherein the knee bar comprises the generally C-shaped mounting clip, a central portion, and an end portion which is laterally offset from the central portion and the mounting clip.

* * * * *